US005701994A

United States Patent [19]

Marsh

[11] Patent Number: 5,701,994

[45] Date of Patent: Dec. 30, 1997

[54] MULTIPLE BOTTLE PACKAGES

[75] Inventor: Dennis R. Marsh, Toledo, Ohio

[73] Assignee: Owens-Illinois Labels Inc., Toledo, Ill.

[21] Appl. No.: 619,223

[22] Filed: Mar. 21, 1996

[51] Int. Cl.[6] ..... B65D 71/08

[52] U.S. Cl. ..... 206/203; 206/151; 206/427; 210/515; 53/398; 53/478

[58] Field of Search ..... 206/203, 427, 206/139, 564, 153, 151; 220/512, 515; 493/926; 53/48.1, 478, 398

[56] References Cited

U.S. PATENT DOCUMENTS

| | | | |
|---|---|---|---|
| 3,151,762 | 10/1964 | Vidal . | |
| 3,184,148 | 5/1965 | Poupitch | 206/203 |
| 3,351,264 | 11/1967 | Bostrom . | |
| 3,353,326 | 11/1967 | Becker . | |
| 4,093,068 | 6/1978 | Smrt . | |
| 4,344,530 | 8/1982 | DeLarosiere | 206/203 |
| 4,754,879 | 7/1988 | Benno . | |
| 4,834,243 | 5/1989 | Langenbeck . | |
| 4,872,560 | 10/1989 | Langenbeck . | |

FOREIGN PATENT DOCUMENTS

| | | | |
|---|---|---|---|
| 936135 | 10/1973 | Canada . | |
| 646435 | 10/1964 | Germany . | |
| 9015758 | 12/1990 | WIPO | 220/515 |

*Primary Examiner*—Jacob K. Ackun
*Assistant Examiner*—Luan K. Tsui

[57] ABSTRACT

A multiple bottle package including a plastic tray including a base wall, an integral peripheral wall extending upwardly from the base wall, and an integral peripheral flange extending radially outwardly from the upper edge of the peripheral. The base wall has a plurality of bottle receiving recesses for receiving the bases of bottles. A plurality of bottles corresponding in number with the number of recesses are placed in the recesses with each bottle having a base received in a recess in the base wall of the plastic tray. Each bottle has a body portion extending upwardly from said base of said bottle, a tapered shoulder portion and a neck portion. The recesses are positioned such that the portions of said body portions of said bottles are in abutting relationship. The peripheral wall of the tray has generally vertical undulations engaging the bottles along the peripheral wall. A canopy overlies and is bonded to the tray. The canopy comprises a thin plastic sheet having openings therein through which the bottles having the closures extend. The thin plastic sheet engages portions of said bottles below the closures and is stretched taut and has ends bonded to the portions of the peripheral flange thereby applying pressure to the bottles to hold said bottles in stable position in said tray such that the package can be readily handled. An integral handle is provided along one side of the tray.

35 Claims, 7 Drawing Sheets

MULTIPLE BOTTLE PACKAGES

This invention relates to multiple bottle packages for beverage bottles which contain liquids and are closed by a closure.

BACKGROUND AND SUMMARY OF THE INVENTION

In the handling of beverage bottles, it is common to provide packages of six or eight bottles in cardboard box type carriers. When larger numbers of bottles are to be handled, customarily they are placed in large cardboard boxes which are not readily handled.

Among the objectives of the present invention are to provide a multiple bottle package which holds twelve bottles in stable relation to one another; which package can be readily handled either with or without an integral handle; which provides surface area for labeling and advertising; and which is adapted for storage and display in wholesale sales stores and bulk food stores and which package can be readily disposed of.

In accordance with the invention, the multiple bottle package comprises a thermoformed plastic tray which receives the filled, labeled and capped bottles and a thin plastic canopy which overlies the bottles. The thin plastic canopy comprises a sheet of thin plastic material having a plurality of spaced openings therein through which the capped ends of the filled bottles extend. The periphery of the openings tightly engage the neck of the bottles below the closure. The thin plastic canopy is bonded to the periphery of the tray such that the canopy is tightly stretched about the bottles such that even pressure is applied to each bottle to hold the bottle in stable position in the plastic tray. The plastic tray includes a base wall, an integral peripheral wall and an integral peripheral flange extending radially outwardly from the peripheral wall to which the thin plastic sheet is bonded as by thermal bonding or welding. The base wall has a plurality of bottle receiving recesses molded therein for receiving the bases of the bottles arranged in the preferred form in three rows, each row having four recesses for holding twelve bottles. An integral handle is provided along one side of the tray.

DESCRIPTION OF THE PREFERRED EMBODIMENTS

Figure 9:
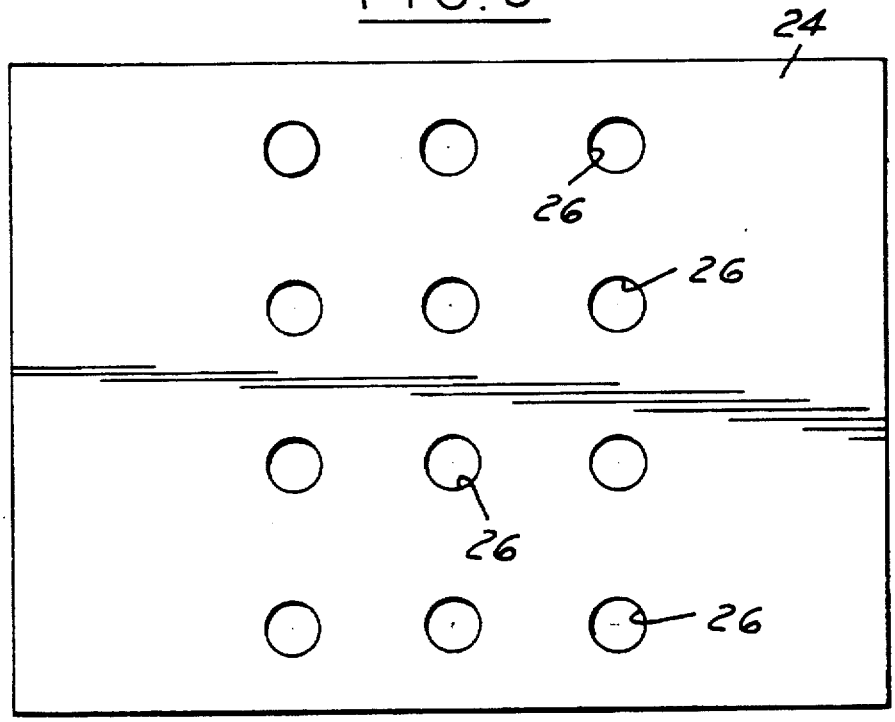
FIG. 9 is a plan view of the plastic canopy utilized in the package shown prior to being applied to form the package.

Referring to FIGS. 1–4, the multiple bottle package 20 embodying the invention comprises a thermoformed plastic tray 22 having recesses for supporting a plurality of filled bottles B capped with closures C and a thin plastic canopy 24 through which the ends of the filled and labeled bottles B and closures C extend as presently described. As shown in FIG. 9, the canopy 24 comprises a thin flexible rectangular plastic sheet including a plurality of openings 26 through which the bottles B and closures C extend. After being placed over the capped bottles B, the skirt 24 is stretched taut and bonded to the plastic tray 22 to apply pressure and retain the bottles B in the plastic tray 22, so that the package 20 can be readily handled.

Figure 6:
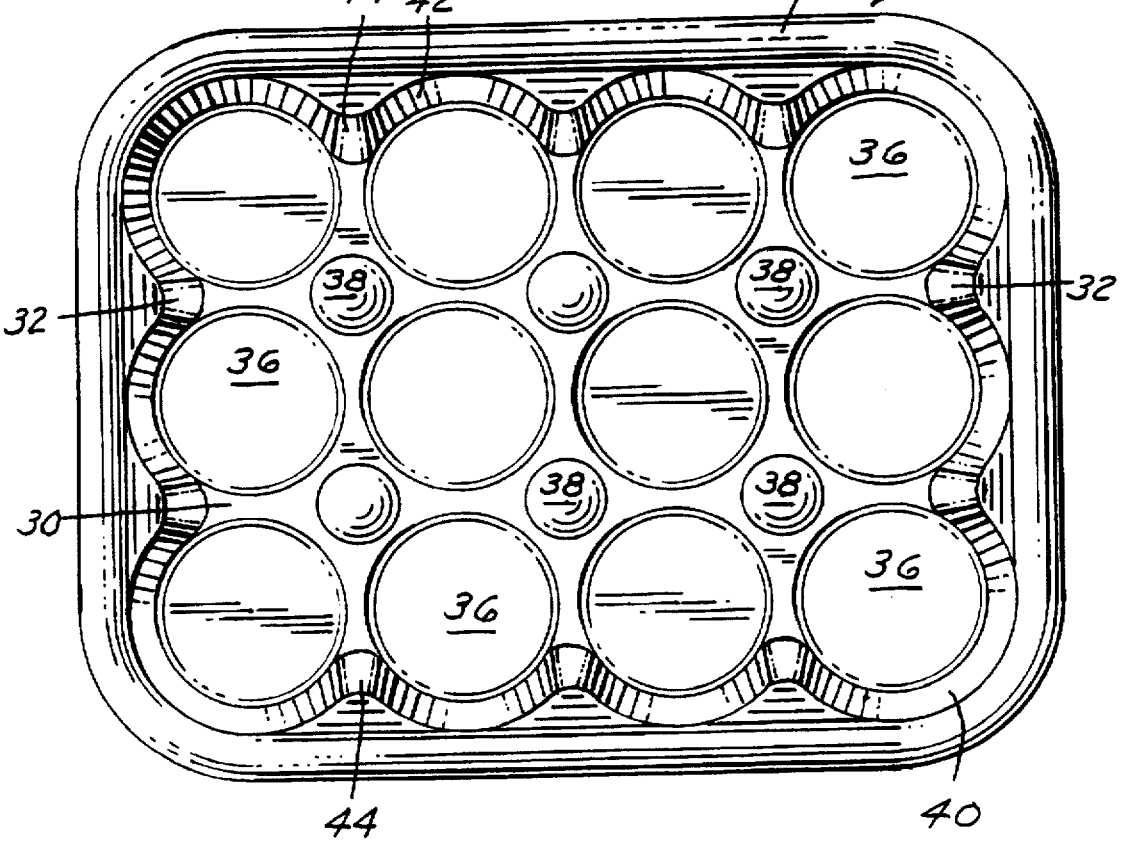
FIG. 6 is a top plan view of the plastic tray utilized in the package.
Figure 7:
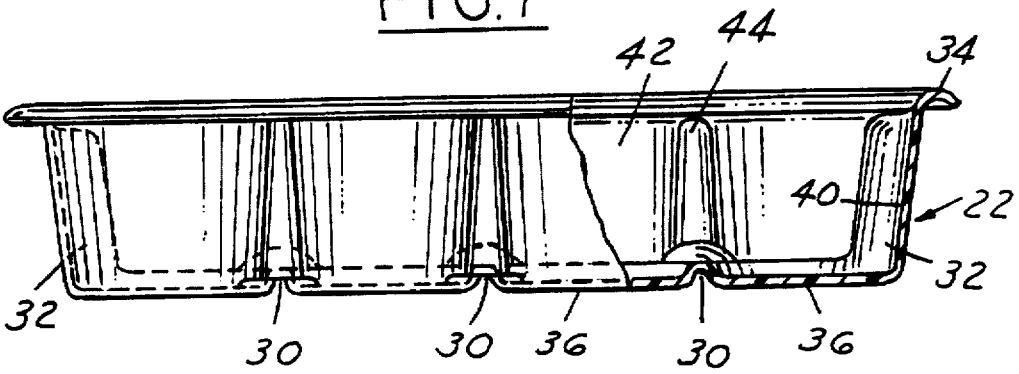
FIG. 7 is a part sectional front elevational view of the plastic tray shown in FIG. 6
Figure 8:
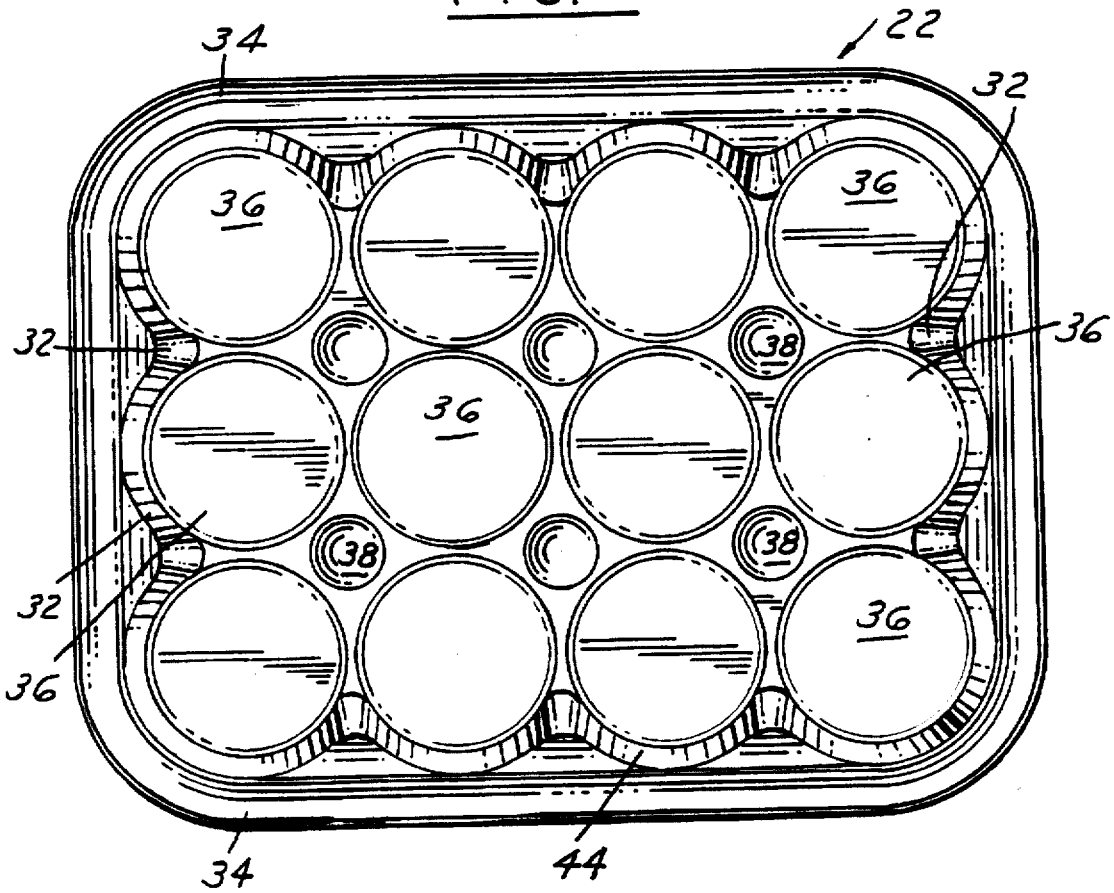
FIG. 8 is a bottom plan view of the plastic tray.

As shown in FIGS. 6–8, plastic tray 22 is generally rectangular and includes a base wall 30, an integral peripheral wall 32 and an integral peripheral flange 34 extending radially outwardly from the upper edge of the peripheral wall 32. The flange 34 is curved defining an upper convex surface and a lower concave surface. Base wall 30 includes a plurality of downwardly molded recesses 36 which are circular and equally spaced to receive the bases of the bottles B. The recesses 36 are preferably arranged in three rows, each of which has four recesses. In addition, base wall 30 includes upwardly extending spherical bosses 38 between the rows of recesses 36 which stiffen the bottom of tray 22 and reduce the torsion end to end.

The peripheral wall 32 of plastic tray 22 has vertical undulations defined by arcuate portions 40, 42 adjacent the recesses 36 along the peripheral wall 32 for engaging the lower portions of the bottles B. The arcuate portions 40 at the corners of the plastic tray 22 extend over 180 degrees and the arcuate portions 42 along the sides of the plastic tray 22 extend less than 180 degrees, for example, about 95 degrees. Each arcuate portion 40, 42 is connected to the adjacent portion by rounded portion 44.

The plastic tray is thermoformed from a flat sheet having a thickness, for example, ranging from 0.032 to 0.038 inches, preferably about 0.036 inch and preferably comprises high density polyethylene. Preferably, the tray is made from high density polyethylene with 25% PCR and regrind and including color such as a blue colorant. The thin plastic sheet 24 from which the canopy 24 is made has a thickness ranging, for example, from 0.002 inches to 0.004 inches, preferably about 0.003 inch and preferably comprises high density polyethylene or low density polyethylene plastic material. The diameter and spacing is determined by the diameter of the bottle. For example, in one type of bottle like that shown in FIG. 9, the diameter is 2.650" for a 10 oz. bottle and 2.938" for a 16 oz. bottle.

Figure 2:
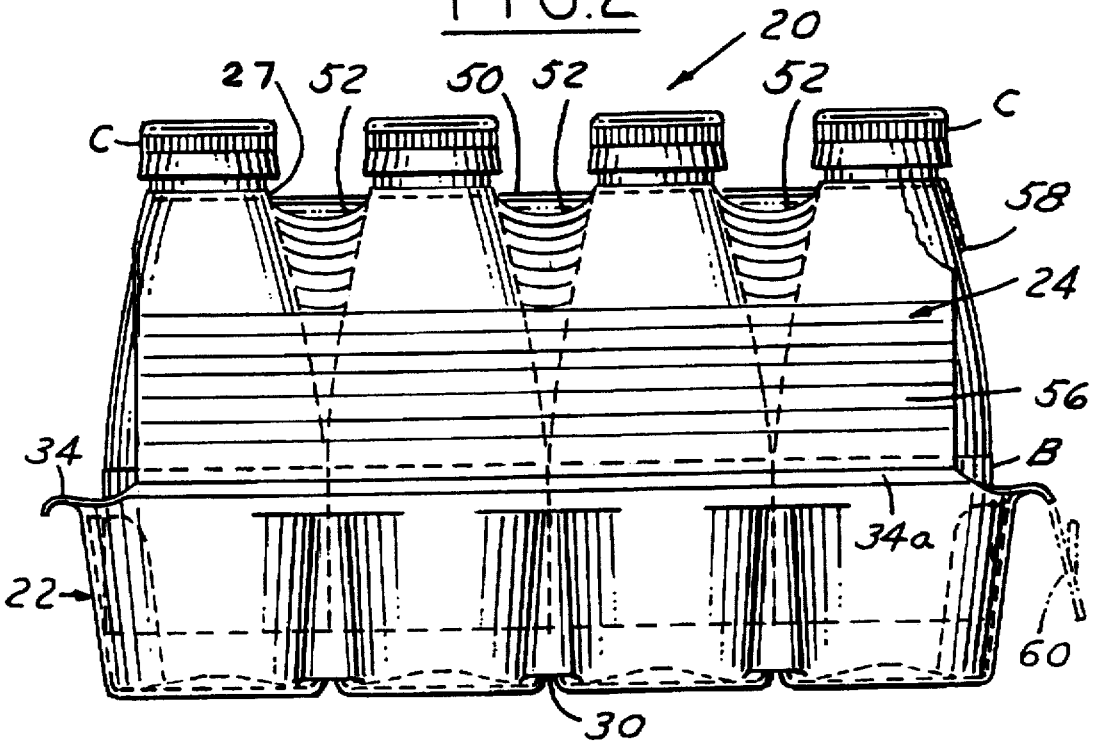
FIG. 2 is a front elevational view of the package.
Figure 3:
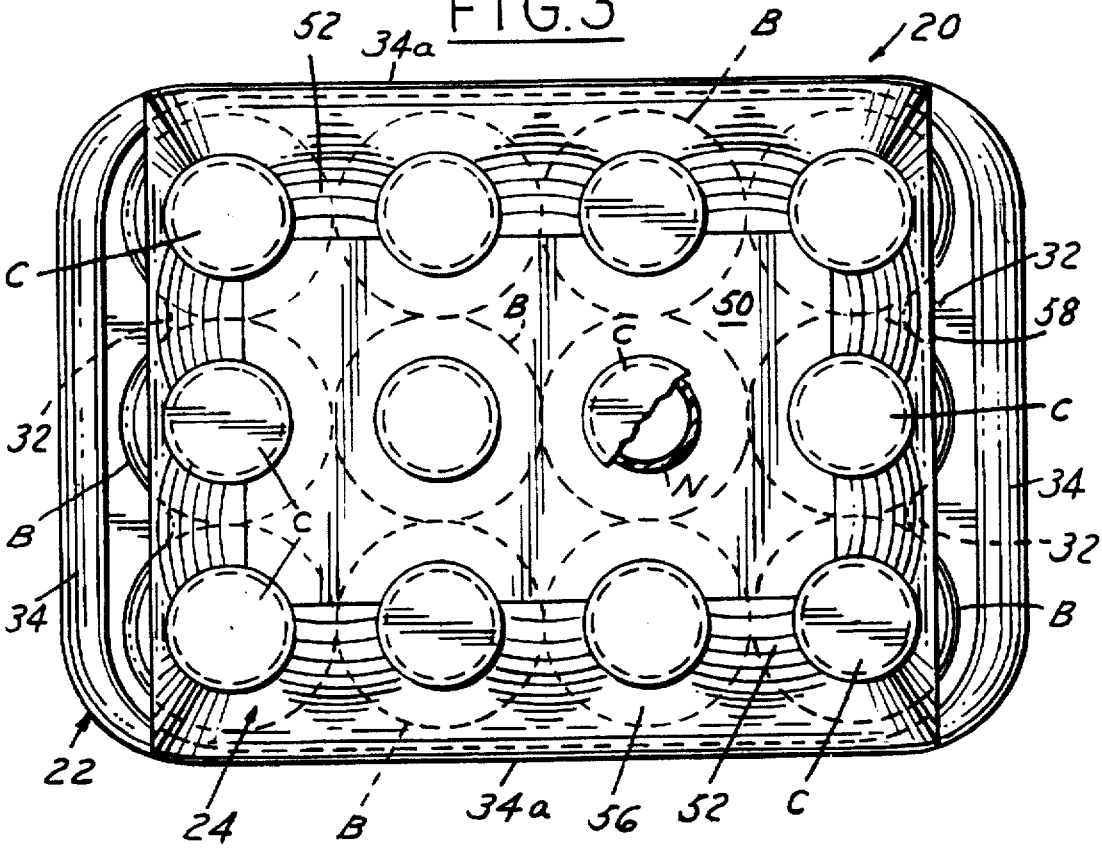
FIG. 3 is a top plan view of the package.
Figure 4:
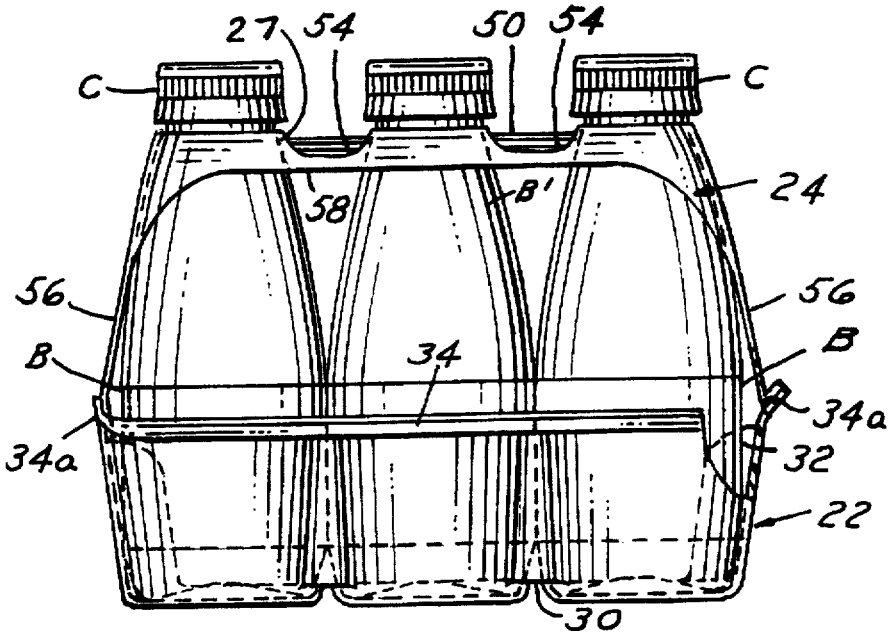
FIG. 4 is an end elevational view taken from the right or left in FIG. 3.
Figure 5:
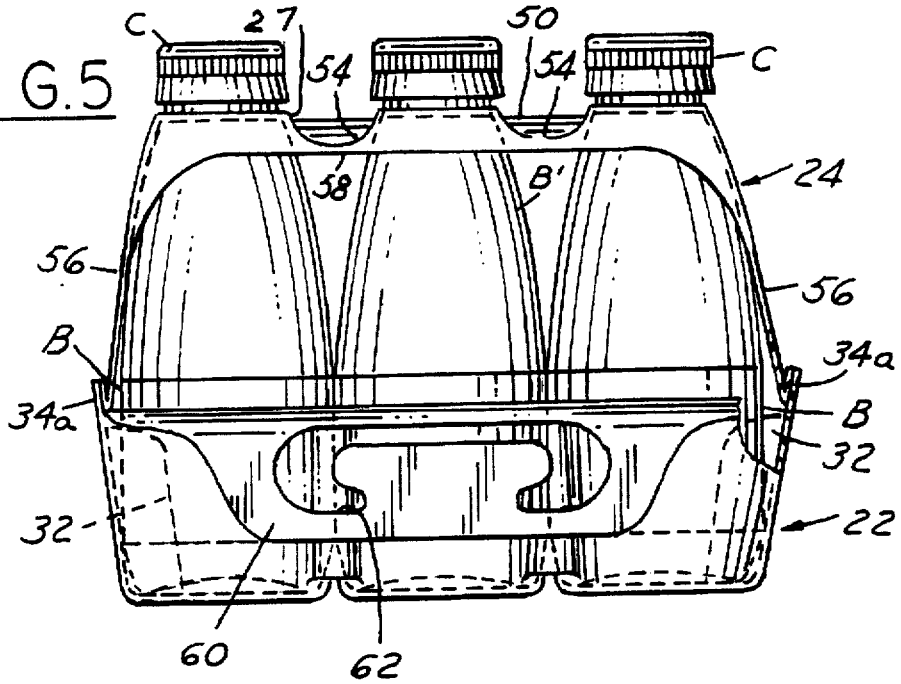
FIG. 5 is a view similar to FIG. 4 of a modified package including an integral handle.

In assembling the package, the filled and capped bottles B are placed in the recesses of 30 of the plastic tray 22. In this position, the bottles abut one another herein shown at about the midpoint of the side wall of the bottles B (FIGS. 2–4).

Figure 10:
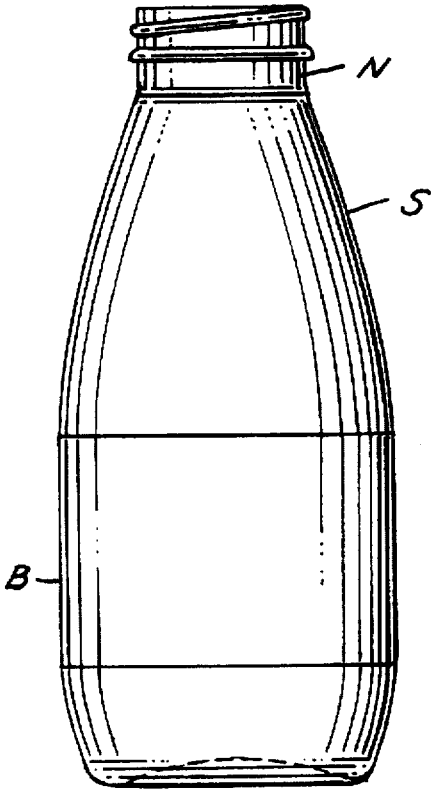
FIG. 10 is an elevational view of a typical bottle forming part of the package.

The rectangular sheet 24 from which the canopy is formed is then placed over the upper ends of the bottles B with the upper ends of the bottles extending through the openings in the sheet and the sides of the openings tightly engaging the bottles below the closures C at the juncture of the neck N and shoulder S of the bottles B (FIG. 10). The sheet is placed over the bottles B such that the short end of the sheet can be bonded to one flange 34 and then to the other flange 34 along the long rows of bottles. The sheet is of a length such that it may be stretched taut to hold the bottles B in position. If needed, the plastic material can be oriented such that it can be shrunk by heat to facilitate the drawing of the sheet taut over the bottles.

Bonding of the canopy 24 to the plastic tray 22 is preferably by heat bond but may also be by other methods such as thermal pulse sealing or thermal bar sealing. In thermal impulse sealing, the two materials to be welded are gripped by a pair of jaws, heated to the melting temperature by an electrical impulse, and then cooled to regain strength, all while under pressure of the jaws. The process produces a good weld but the cycle time is high on the order of 4 seconds. Thermal bar sealing is closely related to heat sealing. Thermal bar sealing uses two brass bars as the die and a heater heats the bars up to the appropriate temperature for welding. With thermal bar sealing, the bars are heated continuously. The two materials are gripped by the bars for approximately ¾ second and then released. The process produces a good weld and the cycle time is low.

Preferably, the extent of drawing the sheet tight is such that the portion of the flange 34 to which the ends of the sheet are attached are bent upwardly as at 34*a*. When in position, the lower portion of the skirt attached to the flange 34 is spaced from the lower portion of the bottle B (FIG. 4).

Figure 1:
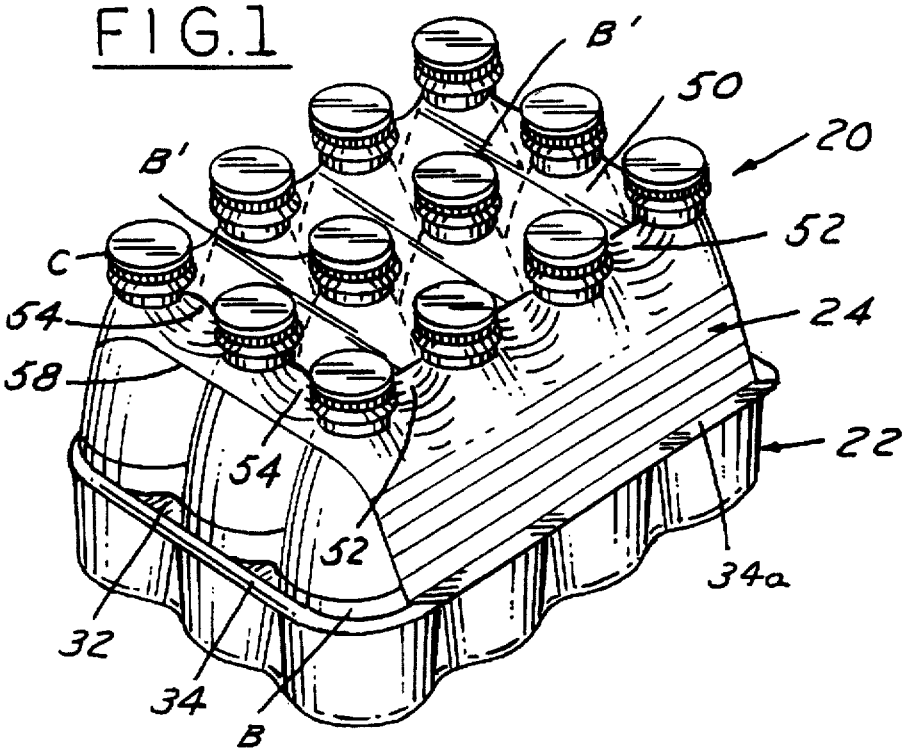
FIG. 1 is a perspective view of the multiple bottle package embodying the invention.

The diameter of the opening in the sheet is less than the diameter of the neck N such that in the assembled position on the bottle B, the canopy 24 forms an annular lip 27 that extends upwardly toward the closure and applies a downward force at the juncture of the neck N and shoulder S of each bottles B. As shown in FIGS. 1–5, when in position, canopy 24 provides a generally flat portion 50 which is taut between the adjacent bottle B. Thus, the flat portion 50 from the inside portions necks N of the bottles along the outside rows to the two inner bottles B (FIG. 1). However, the portions of the canopy 24 on the outside rows of the bottles have undulations 52, 54 as a result of being drawn taut which gradually merge into a flat portions 56, 58 at the free edges of the sheet.

Referring to FIGS. 11–16 a package is provided with a modified tray in order to facilitate stacking of one package on the other and provide strength and resiliency to the recesses. Otherwise, the package is the same. Specifically, each recess 30*a* is tapered upwardly and inwardly and formed with thermoformed radial projections 70 that extend downwardly for engaging either a plastic closure C' or a metal closure C".

Figure 11:
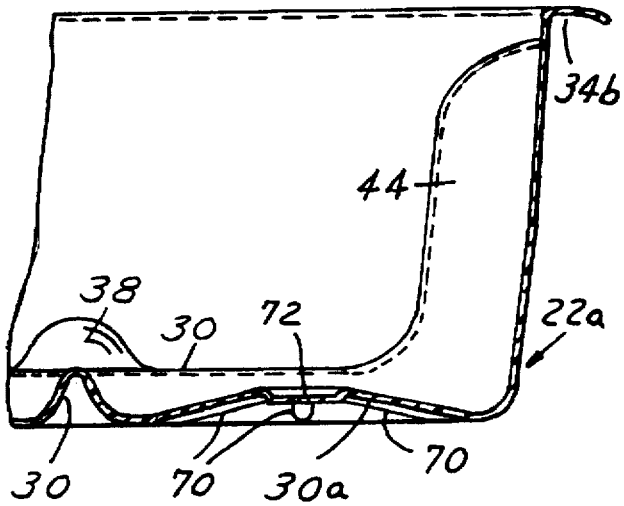
FIG. 11 is a fragmentary part sectional elevational view of a portion of the modified form of tray shown in FIG. 12.
Figure 12:
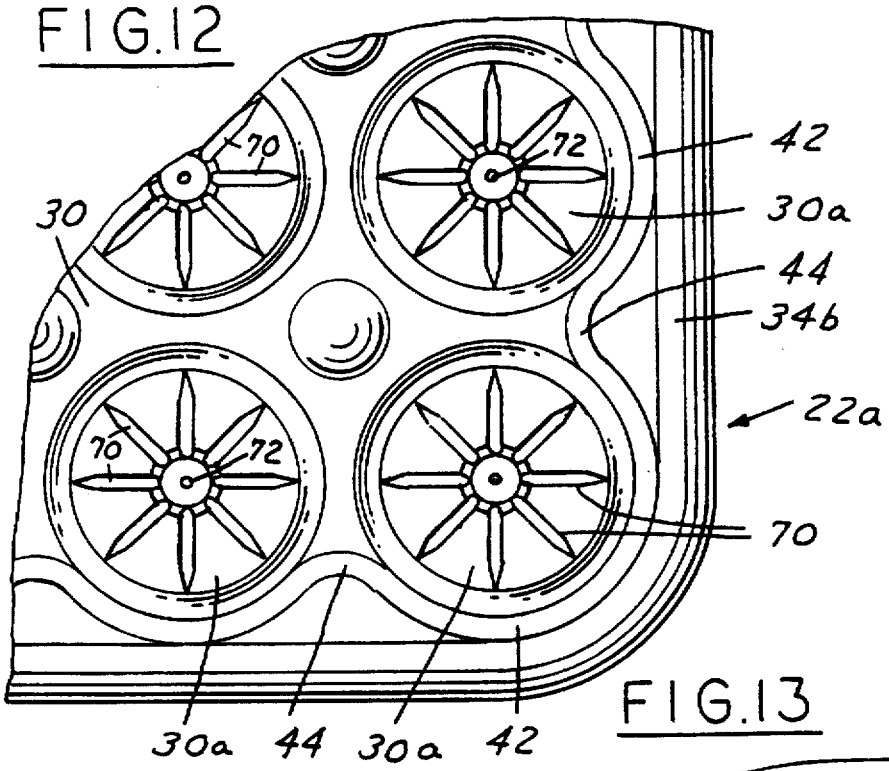
FIG. 12 is an elevational view of a portion of modified tray.

A drain opening 72 may be provided at the center of each recess 30*a* (FIG. 11).

Figure 13:
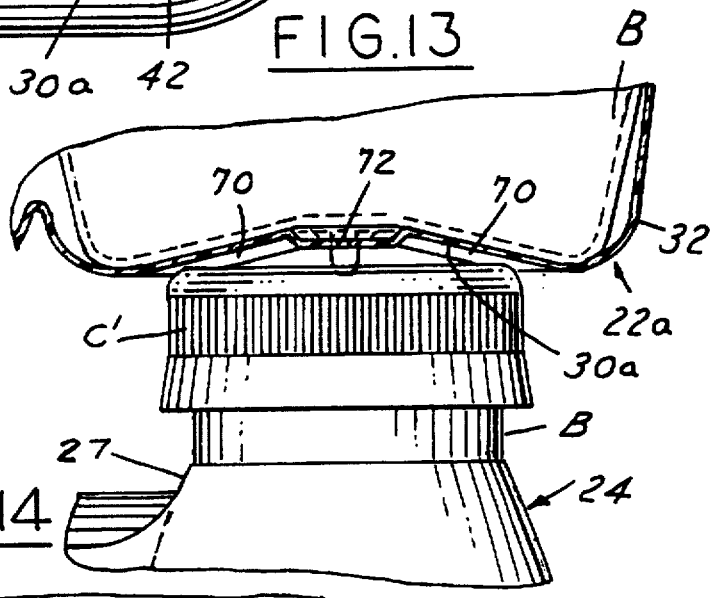
FIG. 13 is a part sectional view on an enlarged scale of a portion of the modified package shown in FIG. 15.
Figure 14:
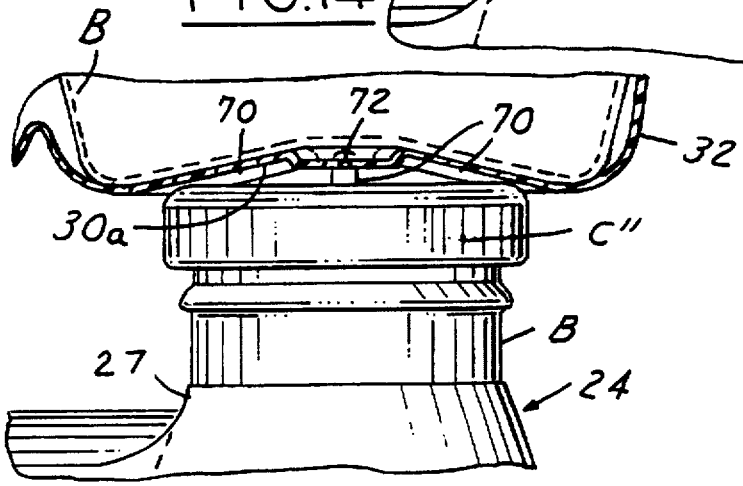
FIG. 14 is a part sectional elevational view on an enlarged scale of a portion of the modified package shown in FIG. 16.
Figure 15:
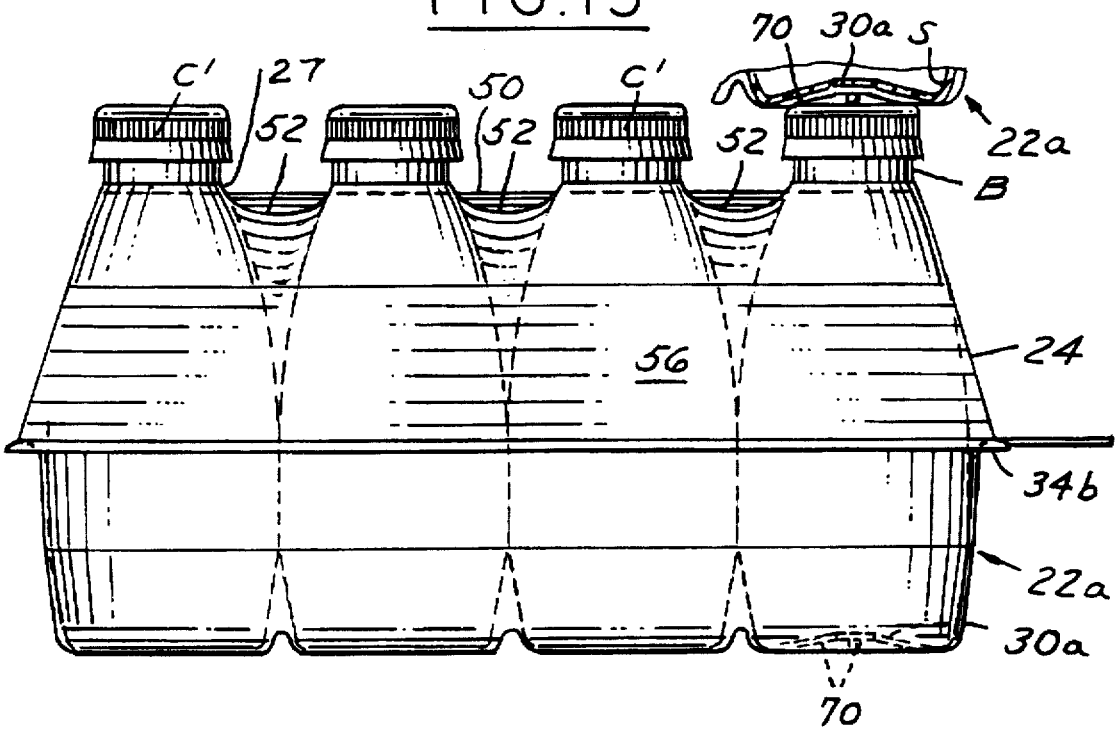
FIG. 15 is a side elevational view of a package utilizing the tray shown in FIG. 12 and having plastic closures on the containers.
Figure 16:
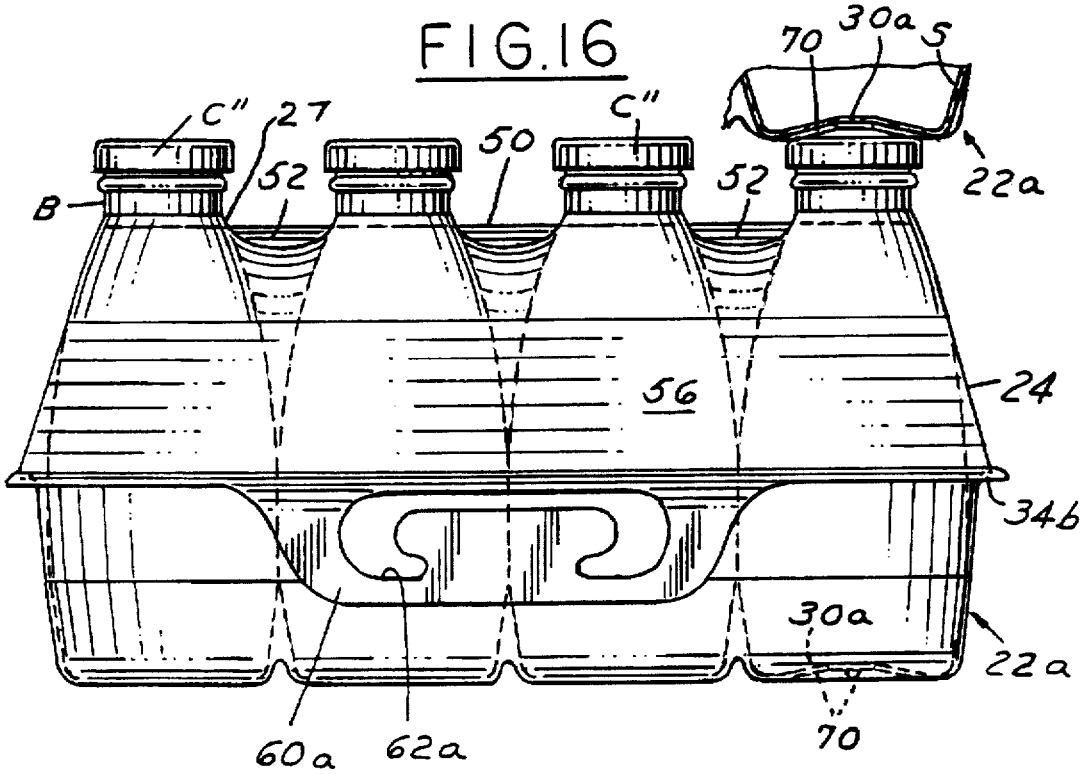
FIG. 16 is a side elevational view of a package utilizing the tray shown in FIG. 12 and having metal closures on the containers and having a handle on the side of the tray.

As shown in FIGS. 13 and 15, the packages having plastic closures may be readily stacked on one another. As shown in FIGS. 14 and 16, the package having metal closures may be readily stacked. As shown in FIG. 16, the handle 60*a* is provided on the long side of the tray 24*a*.

In addition to the form shown in FIGS. 11–16, the tray 22 is preferably formed by a female mold thermoforming and as a result the flange 34*b* is thicken and does not fold upwardly.

It can thus be seen that there has been provided a multiple bottle package which holds twelve bottles in stable relation to one another; which package can be readily handled either with or without an integral handle; which provides surface area for labeling and advertising; and which is adapted for storage and display in wholesale sales stores and bulk food stores and which package can be readily disposed of.

I claim:

1. A multiple bottle package comprising a plastic tray including a base wall, an integral peripheral wall extending upwardly from the base wall, and an integral peripheral flange extending radially outwardly from the upper edge of the peripheral wall, said base wall having a plurality of bottle receiving recesses for receiving the bases of bottles, a plurality of bottles corresponding in number with the number of recesses, each bottle having a base received in a recess in the base wall of said plastic tray, each bottle having a body portion extending upwardly from said base of said bottle, a tapered shoulder portion and a neck portion with a closure thereon, said recesses being positioned such that portions of said body portions of said bottles are in abutting relationship, said peripheral wall having generally vertical undulations engaging said bottles along said peripheral wall, a canopy overlying and bonded to said tray comprising a thin plastic sheet having openings therein, said bottles having the closures extending through said openings, said thin plastic sheet engaging the portions of said bottles below said closures, said thin plastic sheet being stretched taut and having ends bonded to said portions of the peripheral flange thereby applying pressure to said bottles to hold said bottles in stable position in said tray such that the package can be readily handled.

2. The multiple bottle package set forth in claim 1 wherein said plastic tray is rectangular and said recesses are provided in rows thereby providing bottles in rows.

3. The multiple bottle package set forth in claim 2 wherein said undulations in the peripheral wall of said plastic tray comprise arcuate portions engaging portions of the body portions of said bottles in said bottles along said peripheral wall.

4. The multiple bottle package set forth in claim 3 wherein said arcuate portions are connected by rounded generally vertical portions of said peripheral wall.

5. The multiple bottle package set forth in claim 4 wherein said rows of bottles define a rectangular array of bottles, said array having bottles at the corners and bottles between said corners, said arcuate portions of said peripheral wall at the corners extending over 180 degrees and said arcuate portions of said peripheral wall between said corners extending less than 180 degrees.

6. The multiple bottle package set forth in claim 5 wherein said plastic tray has twelve recesses and wherein said bottles number twelve.

7. The multiple bottle package set forth in claim 6 wherein said thin plastic sheet comprising said canopy is stretched such that the portions of the peripheral flange to which the ends of the sheet are bonded are bent generally vertically upwardly relative said peripheral wall of said plastic tray.

8. The multiple bottle package set forth in claim 7 including an integral handle extending from at least one potion of said peripheral flange.

9. The multiple bottle package set forth in claim 1 wherein each said recess tapers upwardly from the periphery of the recess.

10. The multiple bottle package set forth in claim 1 including thermoformed projections extending downwardly from the underside of each said recess to facilitate stacking of packages.

11. The multiple bottle package set forth in claim 10 wherein said projections comprise circumferentially spaced radial projections extending downwardly from the underside of each recess.

12. The multiple bottle package set forth in any one of claims 1–11 wherein each said bottle has a neck, a shoulder and a body portion and the size of the openings is less than the size of the neck such that the periphery of each opening forms an upwardly extending lip which applies a force at the juncture of said neck and said shoulder.

13. The multiple bottle package set forth in claim 12 wherein said closures comprise plastic closures.

14. The multiple bottle package set forth in claim 12 wherein said closures comprise metal closures.

15. The method of making a multiple bottle package comprising forming a plastic tray including a base wall, an integral peripheral wall extending upwardly from the base wall, and an integral peripheral flange extending radially outwardly from the upper edge of the peripheral wall, providing said tray with a plurality of bottle receiving recesses in said base wall for receiving the bases of bottles, providing said peripheral wall of said tray with generally vertical undulations engaging said bottles along said peripheral wall, providing a plurality of bottles corresponding in number with the number of recesses, each bottle having a body portion extending upwardly from said base of said bottle, a tapered shoulder portion and a neck portion with a closure thereon, said recesses being positioned such that portions of said body portions of said bottles are in abutting relationship, placing each bottle having a base in a recess in the base wall of said plastic tray, providing a canopy overlying and bonded to said tray in the form of a thin plastic sheet having openings therein such that said bottles have the closures extending through said openings and said thin plastic sheet engages the portions of said bottles below said closures, stretching said thin plastic sheet taut and having ends and bonding said sheet to said portions of the peripheral flange thereby applying pressure to said bottles to hold said bottles in a stable position in said tray such that the package can be readily handled.

16. The method set forth in claim 15 wherein said step of thermoforming plastic tray comprises forming a generally rectangular tray and providing said recesses in rows thereby providing bottles in rows.

17. The method set forth in claim 16 wherein said step of providing undulations in the peripheral wall of said plastic tray comprises forming arcuate portions engaging portions of the body portions of said bottles in said bottles along said peripheral wall.

18. The method set forth in claim 17 wherein said step of providing arcuate portions comprises providing rounded generally vertical portions of said peripheral wall connecting said arcuate portions.

19. The method set forth in claim 18 wherein said step of providing said bottles comprises forming rows of bottles in a rectangular array of bottles, said array having bottles at the corners and bottles between said corners, said step of providing said arcuate portions of said peripheral wall at the corners being such that said arcuate portions at the corners extend over 180 degrees and said arcuate portions of said peripheral wall between said corners extending less than 180 degrees.

20. The method set forth in claim 19 wherein said step of forming said plastic tray comprises forming twelve recesses and said step of providing bottles comprises providing twelve bottles.

21. The method set forth in claim 20 wherein said step of stretching said thin plastic sheet comprising said canopy being such that the portions of the peripheral flange to which the ends of the sheet are bonded are bent generally vertically upwardly relative said peripheral wall of said plastic tray.

22. The method set forth in claim 21 including forming an integral handle extending from at least one portion of said peripheral flange.

23. The method set forth in claim 22 wherein said step of forming said recesses being such that said recess tapers upwardly from the periphery of the recess.

24. The method set forth in claim 23 including forming thermoformed projections extending downwardly from the underside of each said recess to facilitate stacking of packages.

25. The method set fort in claim 24 wherein said step of forming said projections comprises forming circumferentially spaced radial projections extending downwardly from the underside of each recess.

26. The method set forth in any one of claims 15–25 wherein each said bottle has a neck, a shoulder and a body portion and the size of the openings is less than the size of the neck such that the periphery of each opening forms an upwardly extending lip which applies a force at the juncture of said neck and said shoulder.

27. The method set forth in claim 26 wherein said step of providing said closures comprises providing plastic closures.

28. The method set forth in claim 26 wherein said step of providing said closures comprises providing metal closures.

29. A plastic tray for a multiple bottle package including a base wall, an integral peripheral wall extending upwardly from the base wall, and an integral peripheral flange extending radially outwardly from the upper edge of the peripheral wall, said base wall having a plurality of bottle receiving recesses for receiving the bases of bottles, said recesses being positioned such that portions of the side walls of said bottles are in abutting relationship, said peripheral wall having generally vertical undulations for engaging the bottles along said peripheral wall, said plastic tray being rectangular and said recesses being provided in rows, said undulations in the peripheral wall of said plastic tray comprising arcuate portions adapted to engage portions of the peripheral wall of the bottles in the recesses along said peripheral wall, said arcuate portions being connected by rounded generally vertical portions of said peripheral wall, said rows of recesses defining a rectangular array of recesses, said array having recesses at the corners and recesses between said corners, said arcuate portions of said peripheral wall at the corners extending over 180 degrees, said arcuate portions of said peripheral wall between said corners extending less than 180 degrees, said plastic tray having twelve recesses, and a thin plastic sheet comprising a canopy having ends bonded to opposed portions of said flange and stretched such that the portions of the peripheral flange to which the ends of the sheet are bonded are bent generally vertically upwardly relative said peripheral wall of said plastic tray.

30. The plastic tray set forth in claim 29 including an integral handle extending from at least one portion of said peripheral flange.

31. The plastic tray set forth in claim 30 wherein each said recess tapers upwardly from the periphery of the recess.

32. The plastic tray set forth in claim 30 including thermoformed projections extending downwardly from the underside of each said recess for engaging the closures on the bottles in a second tray and align the bottles in the tray with the bottles in the second tray to facilitate stacking of trays with bottles in said recesses.

33. The plastic tray set forth in claim 32 wherein said projections comprise circumferentially spaced radial projections extending downwardly from the underside of each recess.

34. The plastic tray set forth in claim 33 including a drain opening in each said recess.

35. A multiple bottle package comprising a plastic tray including a base wall, an integral peripheral wall extending upwardly from the base wall, and an integral peripheral flange extending radially outwardly from the upper edge of the peripheral wall, said base wall having a plurality of bottle receiving recesses for receiving the bases of bottles, a plurality of bottles corresponding in number with the number of recesses, each bottle having a base received in a recess in the base wall of said plastic tray, each bottle having a side wall extending upwardly from said base of said bottle, a tapered shoulder portion and a neck portion with a closure thereon, said recesses being positioned such that portions of said side walls of said bottles are in abutting relationship at about the mid point of the side wall of said bottles, and said peripheral wall having generally vertical undulations having a height for engaging portions of said side wails of said bottles along said peripheral wall at a height adjacent said abutting surfaces of said bottles, said undulations in the peripheral wall of said plastic tray comprising arcuate portions engaging portions of the side wall portions of said bottles in said bottles along said peripheral wall, said arcuate portions being connected by rounded generally vertical portions of said peripheral wall, each said recess tapering upwardly from the periphery of the recess, thermoformed projections on said tapered recess, and said projections comprising circumferentially spaced radial projections extending downwardly from the tapered portion of each recess.

* * * * *